United States Patent [19]

Chidester

[11] Patent Number: 4,929,004

[45] Date of Patent: May 29, 1990

[54] VEHICLE DOOR LATCH

[76] Inventor: Patrick H. Chidester, 11828 Old River School Rd. #E, Downey, Calif. 90241

[21] Appl. No.: 329,319

[22] Filed: Mar. 27, 1989

[51] Int. Cl.[5] ..... F05C 17/00

[52] U.S. Cl. ..... 292/267; 292/DIG. 32; 292/DIG. 19

[58] Field of Search ..... 292/267, DIG. 32, 341.12, 292/288, 292, 121, 341.17, 341.15, DIG. 19; 24/702

[56] References Cited

U.S. PATENT DOCUMENTS

| | | | |
|---|---|---|---|
| 2,192,398 | 3/1940 | Devereaux | 292/341.14 X |
| 2,872,232 | 2/1959 | Lawson | 292/341.14 X |
| 3,716,260 | 2/1973 | Herlein | 292/341.12 X |
| 3,934,907 | 1/1976 | McGillivray | 292/DIG. 32 X |
| 4,286,810 | 9/1981 | Ehmen | 292/175 X |
| 4,471,981 | 9/1984 | Wright | 292/292 |

FOREIGN PATENT DOCUMENTS

| | | | |
|---|---|---|---|
| 2606184 | 8/1977 | Fed. Rep. of Germany | 292/341.14 |

*Primary Examiner*—Eric K. Nicholson
*Attorney, Agent, or Firm*—Dominick Nardelli

[57] ABSTRACT

A latch assembly, for holding the doors of trucks and other vehicles in the open position, includes the pivotal latch bar of the prior art but with an improved keeper. The improved keeper has a spring activated lock flap that has one end disposed into the opening formed in the keeper whereby the spring urges the lock flap to its position for closing the opening which receives the latch bar. In addition the latch bar is improved whereby its length can be adjusted to a fixed length in the field.

4 Claims, 1 Drawing Sheet

VEHICLE DOOR LATCH

BACKGROUND OF THE INVENTION

1. Field of the Invention

This invention relates to a latch and, more particularly, to a latch that is simple, positive and rugged for use on relatively large doors of vehicles whereby the door is held securely in the open position.

2. Description of the Prior Art

Latch devices are well known for holding the doors of truck bodies, trailers and other vehicles in the open position. Prior art latches commonly consisted of a latch bar pivotally mounted on the truch body with an enlarged free end receivable in a recess of a keeper that would be mounted on the door which keeper is capable of being positioned, by opening the door, in close proximity to the latch bar. Then one finds that U.S. Pat. No. 3,934,907 teaches to make a latch that is strong, durable and reliable. That prior art patent teaches the use of a leaf spring which is normally untensioned and spaced out of contact with the latch bar that is depending from pin fixed on the body. To use the latch, the bar is lifted whereby it makes sliding contact with the spring. The end of the latch can now be placed into a suitable keeper. Although this system has its advantages, i.e., will not become accidentally unlatched, for example, when moving the vehicle, as stated in the patent it is subject to permanent damage whenever the latch is subjected to relatively large lateral forces. Obviously, the latch then must be replaced.

SUMMARY OF THE INVENTION

Statement:

The present invention teaches that the latch bar for the door latch, like in the prior art, should be mounted onto the body of the vehicle so that the bar is free to pivot at one end about a fixed horizontal axis. Along its body a plurality of pairs of fingers protrude therefrom. The fingers on the same pair are oppositely disposed and each pair is spaced from the adjacent pair. This arrangement allows the bar to be shortened when needed and still have a T-shaped head disposed on the free end. The head as in the prior art is what the keeper receives. However, I have provided a novel keeper that is economically made of sheet metal. The sheet metal has at least one 90-degree bend and is mounted so that is has a portion disposed horizontally and another portion attached thereto depending spaced from the vehicle. An elongated slot is formed in the horizontal portion along the edge formed by the bend and an elongated slot is formed in the depending portion also along the bend, whereby a T-shaped slot is formed. The keeper is then provided with a spring loaded tongue whereby its free end depends and is disposed wthin the elongated portion of the slot. The free end of the tongue is urged by the spring action against the depending portion of the keeper. The T-slot is capable of receiving the T-head on the latch. In so doing the tongue is pivoted away from the depending portion and is urged back after the head is within the slot.

Object:

A primary object of this invention is to provide a door latch that is simple, positive, rugged and adjustable.

Another object of this invention is to provide a door latch that is simple and becomes securely latch.

DETAILED DESCRIPTION OF THE DRAWING

Figure 1:
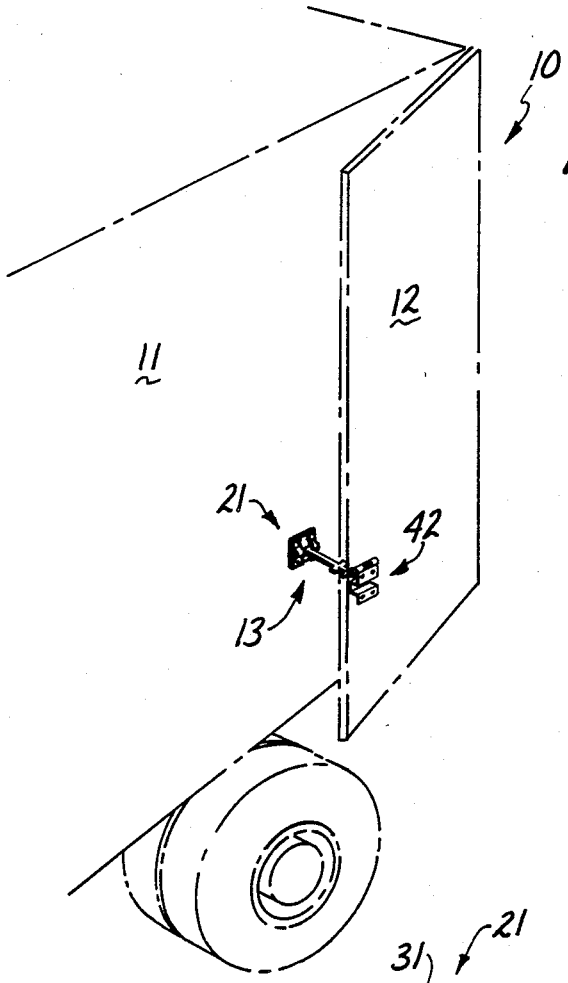
FIG. 1 is a pictorial view of my novel door latch in the latched position and being shown, for example, in relation to a truck body represented in phantom.

Referring to the drawing and to FIG. 1, in particular, the numeral 10 generally designates a vehicle, such as a truck, having a body portion 11, and one or more doors such as door 12. My latch 13 is provided to hold the door 12 in its open position.

Figure 2:
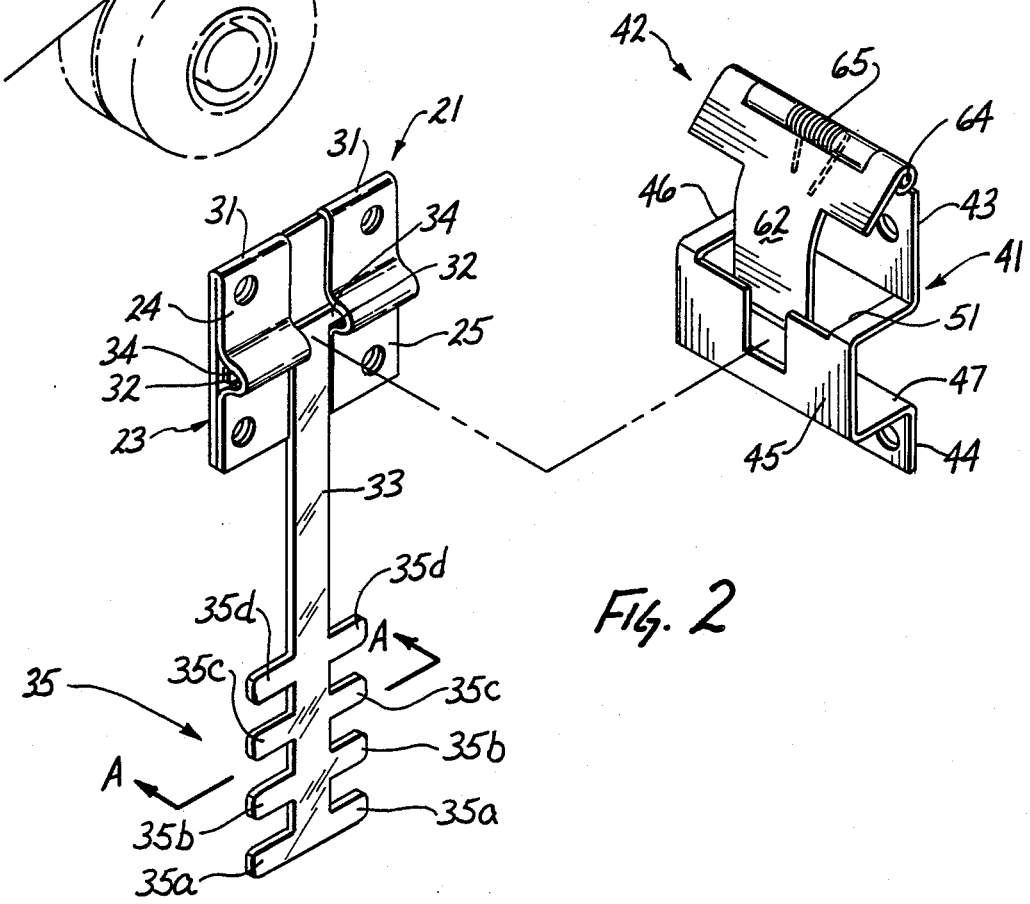
FIG. 2 is an enlarged pictorial view of my latch showing my latch consisting of a bar assembly and a keeper assembly.

Referring to FIG. 2, my latch 13 consists of two parts, a bar assembly 21 and a keeper assembly 22. The bar assembly 21 has a mounting plate 23 made of, for example, sheet metal wherein two flaps 24 and 25 are formed integral with a plate 25, are shown folded as at edge 31 and are so formed to define two aligned openings 32. Assembled to the plate 23 is a latch bar 33 having at one end a pair of laterally projecting, aligned talons of which one talon 34 is more clearly shown. Each talon 34 is disposed to rotate within respective aligned openings 32. In this embodiement the latch bar 33 is shown made of sheet metal. At the other end of the bar 33, a plurality of pairs of fingers 35 are formed. Because the bar is made of sheet material the fingers 35 are conviently disposed within the plane of the material as shown. Also in this embodiment, the bar 33 is shown to have four pairs **35*a*, 35*b*, 35*c* and 35*d* of fingers 35. The respective fingers in each pair are aligned with each other for reasons that will become apparent hereinafter. More or less than fours pairs of fingers 35 can be used without departing from the sprit of my invention. I have chosen multiple pairs of fingers 35 to be placed on my bar 33** so that my bar can be generic, i.e., can be used with various vehicles as will become apparent hereinafter.

Figure 3:
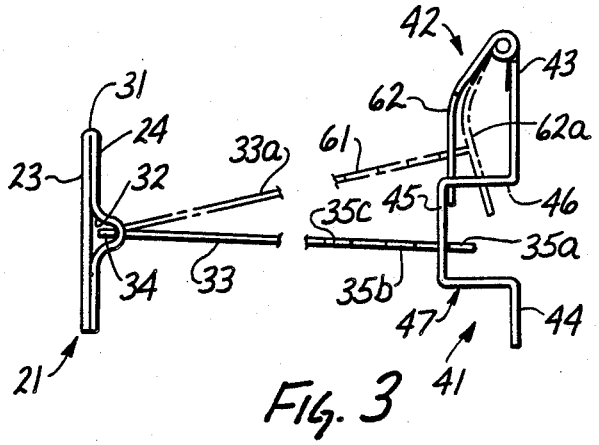
FIG. 3 is a side elevation of my latch showing the two assembly parts in engagement and showing, in phantom the bar assembly coming into engagement with the keeper assembly.

The keeper assembly 22 is also made of, for example, sheet metal and has a bracket 41 shaped as shown in FIG. 2. The bracket could be described as having a U-shaped body 42 with two coplanar mounting flanges 43 and 44. The body 42 has a base 45 and two legs 46 and 47 disposed preferably at 90 degrees to the base 45. An opening 51 is formed in one leg 46 and base 45 as shown formed in the shape of a "T". As shown in FIG. 2, the longer portion or head of opening 51 is formed in leg 46 while the narrow portion or stem of opening 51 is formed in base 45. As shown in FIG. 3, since leg 46 has the longer portion or head of opening 51, the pair **45*a* of fingers can be readily received therein and after being received the bar 33 readily falls within the narrow portion or stem of opening 51 whereby the two become engaged. The phanton lines 61 in FIG. 3 show the bar 33 just before the fingers 35 are retained within the opening 51**.

The keeper assembly 42 also has a spring activated lock flap 62 which has a suitably shaped edge 63 hinged connected to bracket 41, as shown, by a suitable pin 64. Then there is provided a spring 65 so positioned to urge the flap 62 away from the flange 43. As seen the flap 62 is so shaped that its edge removed from edge 63 is disposed within the opening 51, so that the flap 62 is urged by the spring 65 against the base 45.

OPERATION OF THE DEVICE

The latch 13 operates as follows. After the door 12 is opened to the position shown in FIG. 1, wherein the bar assembly 21 and keeper assembly 42 are in close proximity, one lifts the bar 33 whereby its talons 34 rotate within the respective openings 32. When the bar 33 is in the position defined by phantom lines **33*a* in FIG. 2 so that the pair 35*a* of fingers is above the leg 46 on the bracket, the door 12 is moved closer to the body portion 11. The bar 33 is lowered so that the pair 35*a* of fingers enters the T-shaped opening 51. This causes the lock flap 62 to pivot to the postion defined by phantom lines 62*a*. The pair 35*a* of fingers 35 are nested within opening 51 as shown in FIG. 2. Obviously, the flap 62 positively secures the two assemblies whereby they cannot be disengaged unless one pivots the lock flap 62 out of the way to its position marked as 62*a***.

As mentioned above, bar 33 is provided with more than one pair of fingers 35. This feature allows one, in certain application where the door 12 is free to swing closer to the body 11 than in others, to take advantage of this allowance. This is done by making a cut, for example, on a line define as A—A in FIG. 2, whereby two pairs **35*a* and 35*b* of fingers 35 are removed so that pair 35*c* of fingers 35 now engage the keeper assembly 42**.

I claim:

1. A latch for mounting on a first and a second surfaces comprising in combination a bar assembly and a keeper assembly:

said bar assembly having:

a mounting means adapted to be fixed to said first surface;

an elongated bar made of a rigid sheet material and rotatably mounted to said mounting means by one end thereof;

at least two pairs of aligned fingers made integral with and being laterally disposed on said bar at its other end whereby the distance between the first and second surfaces can be adjusted by removing at least one pair of fingers; and each pair of aligned fingers being spaced from the adjacent pair; and each of said fingers being disposed within the plain of said sheet material;

said keeper assembly comprising:

a bracket adapted to be fixed to said second surface;

said bracket being shaped so that a portion thereof is spaced from said second surface to form a space therebetween which has width, as measured between said second surface and said portion, greater than the width of one pair of said fingers and less than the width of two adjacent pairs of said fingers, measured longitudinally along said bar;

said portion of said bracket having a T-shaped opening formed therein;

a lock flap having one edge rotatably mounted to said bracket and having another edge remote from said one edge depending into said T-shaped opening;

a spring means urging said other edge of said flap away from said second surface so that the pair of fingers located on the end said bar is capable of being nested between said portion of said bracket and said second surface.

2. The latch of claim 1 wherein:

said elongated bar has a pair of aligned talons laterally projecting therefrom and being disposed on the end thereof remote from said fingers;

said mounting means has two aligned openings disposed thereon; and each of said talons is disposed in a respective one of said two aligned openings.

3. The latch of claim 1 wherein said mounting means comprises:

a mounting plate;

a pair of flaps adapted to be disposed adjacent said mounting plate and in spaced relationship to each other;

each of said flaps being shaped so that two aligned openings are formed when said pair of flaps are disposed adjacent said mounting plate; and wherein said elongated bar includes:

a pair of aligned talons laterally projecting from said bar and being fixed on the end of said bar remote from said fingers; and each of said talons are disposed in a respective one of said two aligned openings.

4. The latch of claim 1 wherein:

said bracket in said keeper assembly is made of a rigid sheet material;

said shape of said bracket is defined to include:

a U-shaped body forming a base and two legs attached to said base, a mounting flange each fixed to a respective one of said legs and opposite of said base, and one of said legs and said base having formed therein said T-shape opening wherein the wider head portion of said T-shape opening is formed in said one leg and the narrower stem portion of said T-shape opening is formed in said base; and said lock flap is mounted in rotatable relationship with one of said mounting flanges that is fixed to said one leg.

* * * * *